United States Patent [19]

Kittle

[11] Patent Number: 4,522,090

[45] Date of Patent: Jun. 11, 1985

[54] COMBINATION VEHICLE, SHOCK ABSORBER AND TOOL TO REMOVE SAID SHOCK ABSORBERS FROM SAID VEHICLE

[76] Inventor: Donald Kittle, 2427 Ingalls Ave., Apartment 304, Joliet, Ill. 60435

[21] Appl. No.: 490,933

[22] Filed: May 2, 1983

[51] Int. Cl.[3] ..... B25B 13/00

[52] U.S. Cl. ..... 81/55

[58] Field of Search ..... 81/55, 56, 13, 57.39

[56] References Cited

U.S. PATENT DOCUMENTS

| | | | |
|---|---|---|---|
| 2,752,809 | 7/1956 | Lehmann | 81/55 |
| 3,889,558 | 6/1975 | Duncan | 81/55 |
| 3,935,760 | 2/1976 | Taylor | 81/55 |
| 4,329,892 | 5/1982 | Daigle | 81/55 |

*Primary Examiner*—James L. Jones, Jr.

*Attorney, Agent, or Firm*—Ernest Kettelson

[57] ABSTRACT

A tool to remove shock absorbers from an automobile comprising an elongated barrel or tubular portion have a hollow bore extending therethrough and a ribbed socket at one end to receive the retaining nut at the top of a shock absorber mounted on an automobile. The barrel or tubular portion has an abutment flange extending outwardly along the side wall to catch and bear against a portion of the A-frame part of the vehicle which is adjacent to the shock absorber. The abutment flange keeps the barrel or tubular portion of the tool from rotating and holds the retaining nut received in the socket of the tool from rotating. A socket wrench is inserted down through the bore of the barrel or tubular portion of the tool to receive the head of the bolt or rod which holds the shock absorber in place. The cross-sectional configuration of the cavity of the socket wrench corresponds to the cross-sectional configuration of the head of the shock absorber bolt, whereby the bolt or rod can be rotated to unscrew from the retaining nut while the latter is held by the barrel or tubular portion of the tool having its abutment flange engaged against a portion of the A-frame to keep it and the retaining nut from rotating. The threaded portion of the rod or bolt is rotated until it has become completely disengaged from the retaining nut after which the shock absorber can be removed.

8 Claims, 10 Drawing Figures

COMBINATION VEHICLE, SHOCK ABSORBER AND TOOL TO REMOVE SAID SHOCK ABSORBERS FROM SAID VEHICLE

BACKGROUND OF THE INVENTION

This invention relates to the field of tools used for special purposes and in this case to remove shock absorbers from automobiles or other vehicles so they can be replaced.

One of the main problems in removing old shock absorbers which are to be replaced with new ones is that they are difficult to get at with conventional tools. Also, after having been on the vehicle a lengthy period of time, the retaining nut tends to become set or seized on the bolt which holds the shock absorber in place. Therefore, besides being difficult to get at, a substantial amount of force is required both to hold the retaining nut against rotation and to then rotate or unscrew the threaded rod or bolt which holds the shock absorber.

Other prior art tools used for specialty purposes in different applications, that is other than to remove shock absorbers, include the following U.S. patents. U.S. Pat. No. 3,731,559 discloses what is called an inside-outside spud wrench for use particularly in putting together and taking apart inlet connections on urinals and commodes. U.S. Pat. No. 2,601,796 discloses a tappet wrench for adjusting tappets of an internal combustion engine. U.S. Pat. No. 2,599,489 discloses a tool for adjusting valve clearance for an internal combustion engine. U.S. Pat. No. 1,973,940 discloses a combination tool for adjusting the clearance of a rocker arm on an internal combustion engine. U.S. Pat. No. 1,509,258 discloses another combination wrench, this one for the special purpose of taking apart spark plugs. One of the main problems with tools known to the prior art of the type disclosed in the foregoing patent is that both hands of the mechanic or other workman are needed to operate the tool, one hand holding a lever having a socket or other type of wrench fitting at its end to hold that one from rotating while the mechanic's other hand grasps the handle or lever portion of a wrench seated on a second nut or bolt head or other portion of something that is to be rotated relative to the other part. In the case of removing shock absorbers from an automobile or other vehicle, there is insufficient room for a mechanic to get both of this hands into the close spaced available for work adjacent to the shock absorber installed on the vehicle. Therefore, such prior art tools are not feasible for use in this particular application relating to removal of shock absorbers from motor vehicles. The present invention overcomes such problem by providing an abutment flange extending outwardly from the exterior wall of an elongated tubular member or barrel of the tool which engages and abuts against a portion of the A-frame thereby preventing further rotation of the retaining nut held in the socket portion of the elongated tubular member. In this manner the retaining nut of the shock absorber assembly can be held without the mechanic having to hold any portion of the tool which holds the retaining nut with his hand. Since the elongated tubular member has a hollow bore extending down through its center of a substantial diameter, a second tool portion can be inserted down through the central bore, such tool having a socket head at its free end to engage the corresponding head portion of the threaded bolt which holds the shock absorber in place. Such second tool can be readily rotated by the mechanic using only one hand to unscrew the threaded bolt from the retaining nut.

SUMMARY OF THE INVENTION

It is an object of the invention to provide a tool to remove shock absorbers from a vehicle in which the mechanic needs to use only one hand.

It is an object of the invention to provide a tool to remove shock absorbers from a vehicle without the necessity of cutting the bolt or the retaining nut.

It is an object of the invention to provide a tool to remove shock absorbers from a vehicle comprising an elongated tubular portion having a relatively large diameter hollow bore extending through the tubular portion with a socket at one end to receive the retaining nut at the top of a shock absorber in place on the vehicle, an abutment flange extending outwardly along the side wall of the tubular portion to catch and bear against a portion of the frame part of the vehicle which is adjacent to the shock absorber to thereby hold the retaining nut against the rotation while a second tool is placed through the hollow bore of the tubular portion to seat on the head of the retaining bolt for rotation thereof to remove the shock absorber.

DESCRIPTION OF PREFERRED EMBODIMENT

Figures 1, 2:
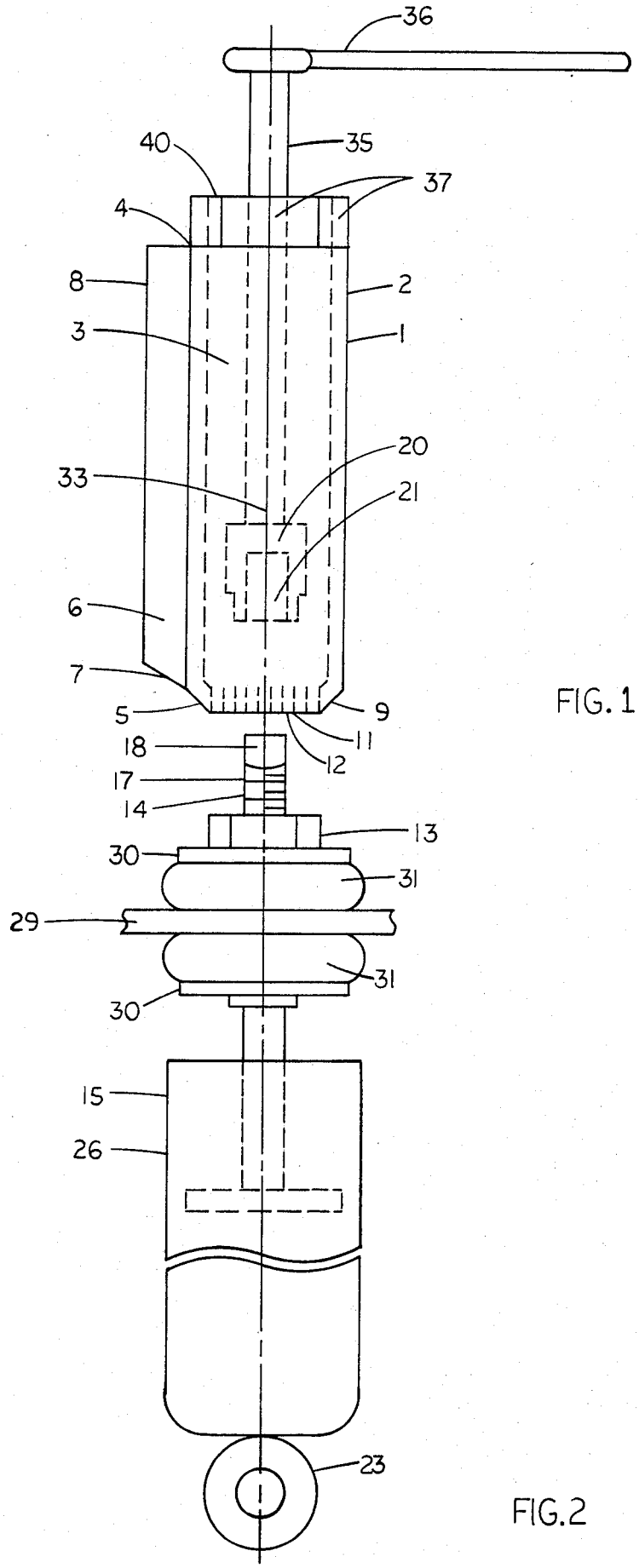
FIG. 1 is a side elevation view of a tool to remove a shock absorber in accordance with this invention with internal portions thereof shown in phantom by broken lines.
FIG. 2 is a side elevation view of a shock absorber having a portion of its cylindrical body broken away and an internal part thereof shown in phantom by broken lines.
Figure 3:
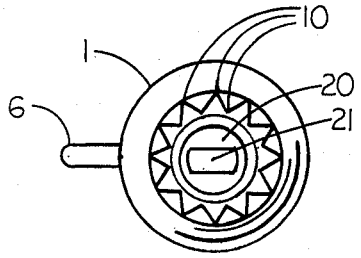
FIG. 3 is a plan view from the bottom of the tool shown in FIG. 1.
Figure 4:
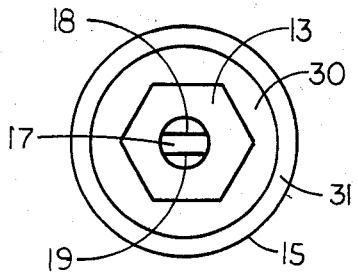
FIG. 4 is a plan view from the top of a shock absorber of the type shown in FIG. 2.
Figure 5:
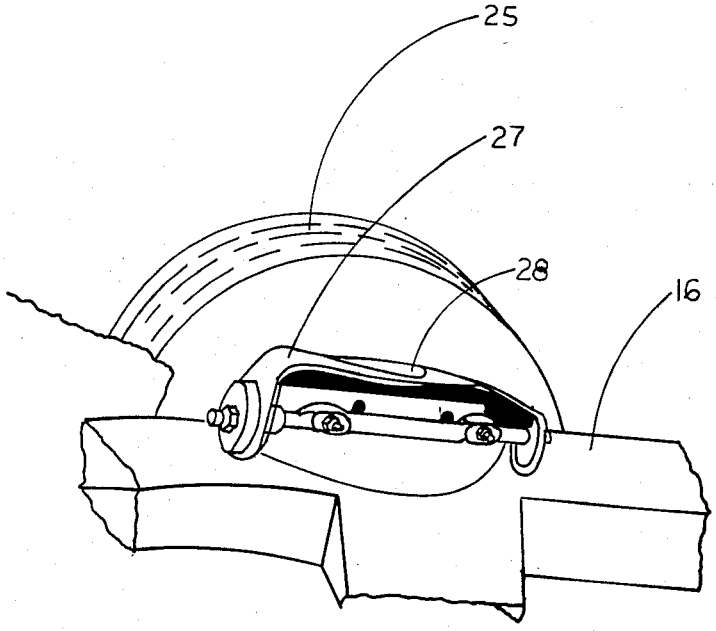
FIG. 5 is a perspective view of a portion of an automobile with parts thereof broken away to illustrate the A-frame to which the upper portion of the shock absorber is connected and its relationship in general to the rest of the automobile.
Figure 6:
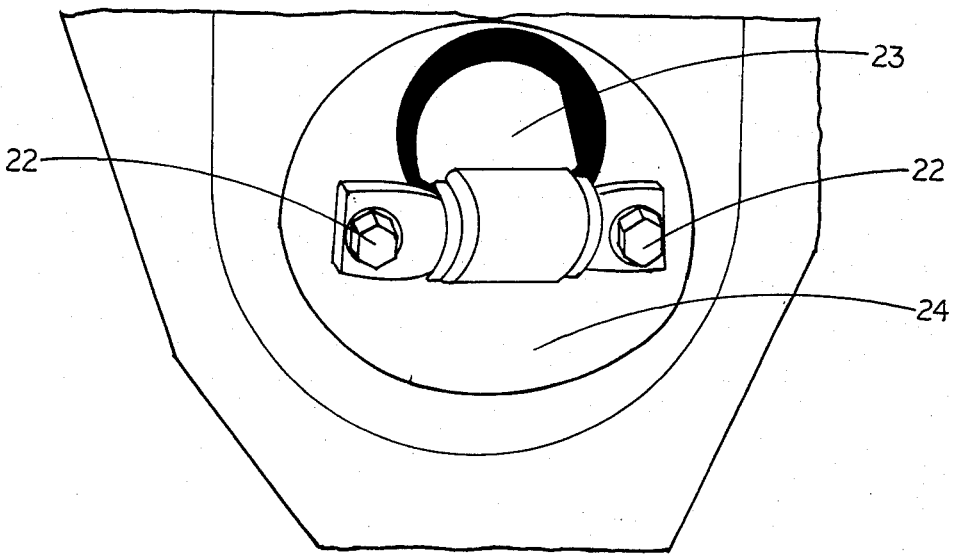
FIG. 6 is a perspective view of an under-portion of an automobile showing the connection of the lower portion of a shock absorber to a member of the automobile that is connected to the axle and in turn one of the wheels of the vehicle.
Figure 7:
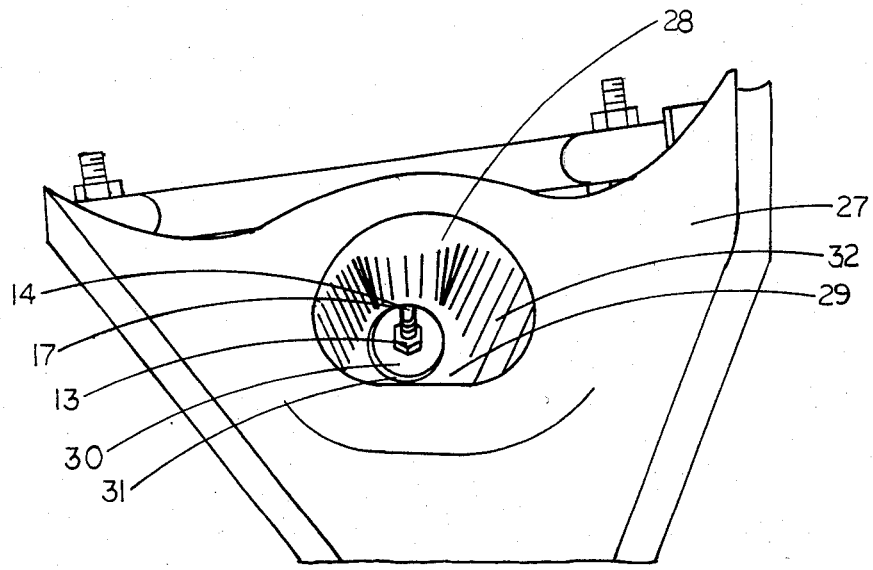
FIG. 7 is a perspective view of the A-frame of a vehicle looking from the top, illustrating the connection of the upper portion of a shock absorber which the tool in accordance with this invention is engageable with to remove the shock absorber.
Figure 8:
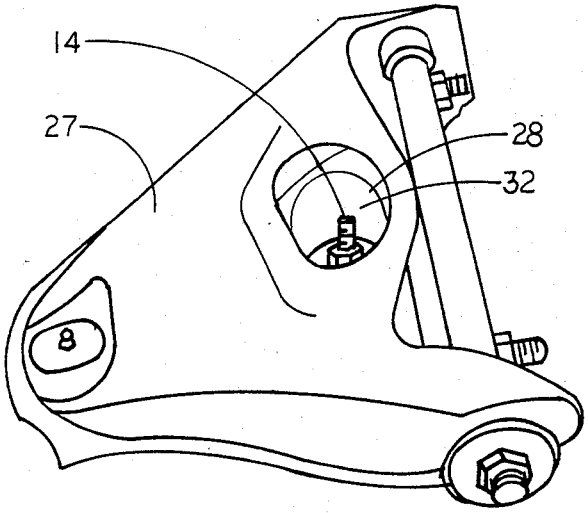
FIG. 8 is a perspective view of the A-frame of the vehicle looking down the front, illustrating the well in which the upper portion of the shock absorber is connected.
Figure 9:
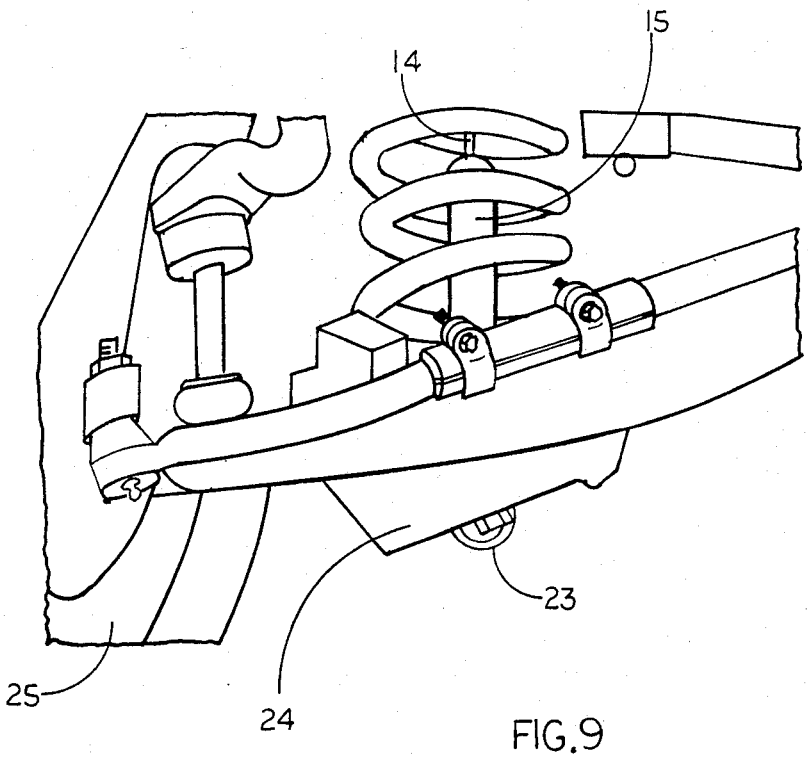
FIG. 9 is a side elevation view of a shock absorber connected to a vehicle, illustrating the lower portions of the shock absorber and the reciprocating rod extending upwardly from the cylindrical body portion.
Figure 10:
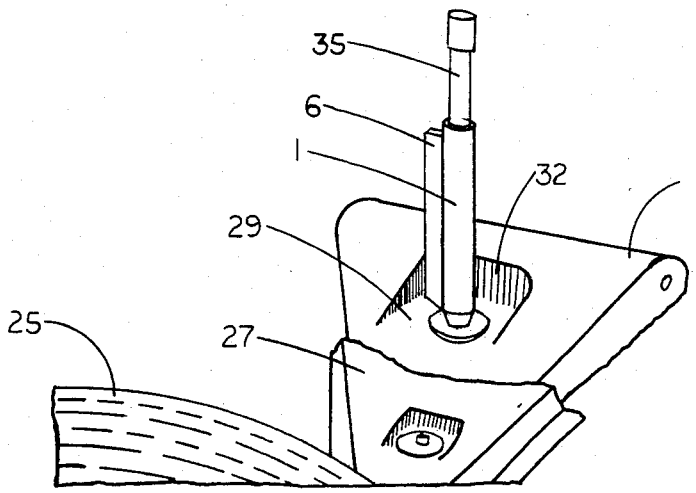
FIG. 10 is a perspective view of the A-frame of a vehicle similar to FIG. 7 showing the tool in accordance with this invention inserted in the well of the A-frame for engagement with the retaining nut and holds the upper portion of the reciprocating rod to the floor of the A-frame.

A tool to remove shock absorbers from a vehicle in accordance with this invention comprises an elongated barrel or tubular portion 1 having a circular peripheral side wall 2 surrounding an elongated hollow bore 3 extending through the tubular portion 1 from its upper end 4 to its lower end 5.

An elongated flange 6 projects outwardly from the peripheral side wall 2 with which it is integrally formed, extending from the upper end 4 of the tubular portion 1 to the lower end 5 of the tubular portion 1. The lower end 7 of the flange 6 tapers in an upwardly inclined direction from the peripheral side wall 2 of the tubular portion 1 to the outer edge 8 of the flange 6.

The lower end portion 5 of the tubular portion 1 tapers downwardly and inwardly forming a tapered annular border region at the lower end 5 of the tubular portion 1. The hollow bore includes at that portion concentric with the tapered annular border 9 a plurality of spaced apart ribs 10 in an annular ring surrounding the opening 11 at the lower end 5 of the tubular portion 1 thereby providing a socket 12 to seat on the retaining nut 13 of the reciprocating bolt or rod 14 which holds the shock absorber 15 in place on the vehicle 16.

The threaded upper end 17 of the reciprocating rod or bolt 14 includes a pair of opposed flats 18 and 19 on which a socket wrench 20 having a cavity 21 of corresponding cross-section can be seated to engage the rod or bolt 14 for rotation relative to the retaining nut 13. As the threaded portion of the reciprocating rod 14 is rotated relative to the retaining nut 13 in one direction it will eventually pass through the retaining nut 13 thereby enabling removal of the shock absorber 15 from the vehicle 16.

Shock absorbers 15 are typically mounted in automobiles or other vehicles 16 by bolting the lower end 23 of the shock absorber 15 to a frame portion 24 of the vehicle which is movable with the axles to which the vehicle wheels 25 are connected. The shock absorber includes a body portion 26 which may comprise a hydraulic or pneumatic cylinder which provides a damping or shock absorbing effect to a piston mounted therein to which the reciprocating bolt 14 is connected. The body portion 26 of the shock absorber therefore moves reciprocally up and down relative to the reciprocating rod 14 as the vehicle travels over the roadway, thereby damping or absorbing the shocks as the wheels 25 roll over bumps and other uneven surfaces in the road. The threaded upper end 17 of the reciprocating rod 14 is connected to a typical vehicle 16 at a portion of its body known as an A-frame 27. The A-frame has a generally triangular peripheral configuration and includes a well portion 28 which includes a floor 29. The upper end 17 of the reciprocating rod 14 extends through an aperture in the floor 29 of the well portion 28 and projects upwardly into the lower part of the well 28 of the A-frame 27. The upper end 17 of reciprocating rod 14 is secured to the floor 29 of the well 28 by the retaining nut 13 tightened on the threaded shank of the upper end 17 of the reciprocating rod 14, the retaining nut being seated against a washer 30 which in turn seats against a compressible grommet 31 which lies against the floor 29 of the well 28. Another retaining nut 13 is secured in similar fashion against the other side of the floor 29. With the shock absorber connected to the vehicle in this manner, as the body portion 26 of the shock absorber moves up and down with the wheels as they travel over bumps in the roadway, the upper portion of the shock absorber 15 which comprises the reciprocating rod 14 bolted to the well 28 of the A-frame 27 keeps the body of the vehicle to which the A-frame is rigidly connected from moving up and down at the same rate and frequency as the wheels and the axles of the vehicle. In other words this connection of the shock absorber to the vehicle smoothes out the road shocks and provides a smooth ride.

The well portion 28 of the A-frame 27 is of generally square, rectangular or ovular configuration and has a cross-section somewhat larger than the cross-section of the washer 30 and the grommet 31. There is very little clearance in which to use a conventional type of wrench to seat on the retaining nut 13 and at the same time place another conventional wrench on the opposed flats 18 and 19 at the upper ends 17 of the reciprocating rod 14. The tool in accordance with this invention provides the elongated flange 6 as described above which extends outwardly from the peripheral side wall 2 of the tool a sufficient distance to engage the side wall 32 of the well portion 28 when the socket 12 at the lower end 5 of the tool is seated on the retaining nut 13. When the flange 6 engages and bears against the side wall 32 of the well 28, it holds the retaining nut 13 against further rotation whereupon the threaded portion of the reciprocating rod can be rotated relative to the retaining nut for eventual removal. The distance of the outer edge 8 of the flange 6 from the central axis 33 of the bore 3 of the tool is greater than the distance between the longitudinal axis 34 of the reciprocating rod 14 and the side wall 32 of the well 28 at the closest portion of the side wall 32 to the longitudinal axis 34. Since the cross-sectional configuration of the well 28 is generally square, rectangular or ovular, at least one portion thereof is farther from the longitudinal axis 34 of the reciprocating rod 14 than the nearest portion of the side wall 32 to the longitudinal axis 34. The distance between the outer edge 8 of the flange 6 and the central axis 33 of the bore 3 of the tool is less than the distance between the longitudinal axis 34 of the reciprocating rod 14 and the farthest point on the side wall 32 of the well 28. In this way, the elongated barrel or tubular portion 1 of the tool in accordance with this invention can be inserted down into the well 28 of the A-frame 27 to seat the socket 12 on the retaining nut 13, with the flange 6 projecting outwardly in the space between the longitudinal axis 34 of the reciprocating rod 14 and the farthest point of the side wall 32 of the well portion 28 therefrom.

The hollow central bore 3 of the elongated barrel or tubular portion 1 has a diameter large enough to enable the socket wrench 20 to be inserted and seated for engagement on the pair of opposite flats 18 and 19 at the upper end 17 of the reciprocating rod 14. An elongated extension shaft 35 extends from the socket portion of the socket wrench 20 upwardly beyond the upper end 4 of the elongated barrel or tubular portion 1 of the tool in accordance with this invention and a handle 36 extends laterally from the extension shaft for a mechanic to grasp to rotate the reciprocating rod until its threaded portion has passed through the retaining nut 13 thereby enabling disconnection of the shock absorber from the A-frame 27. When the handle 36 of the socket wrench 20 is first rotated by the mechanic, the retaining nut 13 tends to rotate therewith until the elongated flange 6 of the tool and its socket 12 engaged with the retaining nut 13 reaches a portion of the side wall 32 of the well 28 which is relatively closer to the longitudial axis 34 of the reciprocating rod 14. At such point the flange 6 abuts against the side wall 32 of the well 28 in such a way that it prevents further rotation of the retaining nut 13 held by the socket 12 of the elongated barrel or tubular portion 1 of the tool in accordance with this invention. Further rotation of the socket wrench 20 and the reciprocating rod 14 engaged therewith continues until the threaded portion of the reciprocating rod has completely passed through the retaining nut 13.

When the portion of the shock absorber 15 which is connected to the A-frame 27 has been removed by the tool in accordance with this invention in the manner described above, it is then a relatively simple matter to disconnect the lower portion of the shock absorber 15 from that part of the vehicle to which the lower portion of the shock absorber is connected. The elongated flange 6 extends along the outer wall of said tubular member 1 in a direction substantially parallel with the central axis of the hollow bore 3 which extends through said tubular member 1.

The plurality of spaced apart ribs 10 which extend in an annular ring surrounding the opening 11 at the lower end 5 of the tubular portion 1 extend in a direction parallel with the central axis 33 of the bore 3 of the tubular portion 1.

In a modified form of the invention, the elongated barrel of tubular portion 1 is sufficiently long to project above the well 28 of the A-frame 27 and a plurality of flat faces 37 are formed around the outer periphery of the upper end 40 of this modified embodiment of the invention, thereby providing the peripheral configuration of a square if four flat faces are provided, or a hexagon if six flat faces are provided, or an octagon if eight flat faces are provided. Such upper end portion 40 can be engaged by an open end wrench or a box wrench to hold the tubular portion 1 against rotation when the reciprocating rod 14 is being rotated in the direction of removal by the socket wrench 20.

I claim:

1. A combination vehicle, shock absorber and tool to remove said shock absorber from said vehicle, wherein said vehicle includes a first frame portion and a second frame portion, said first frame portion being relatively fixed in relation to the body of said vehicle, said second frame portion being relatively fixed in relation to a corresponding one of the axles and wheels of said vehicle, said shock absorber having a shock absorbing cylindrical member connected at one end to said second frame portion, and a reciprocating rod member connected at the oposite end of said shock absorber to said first frame portion, a retaining nut, said retaining nut connecting said shock absorber to said first frame portion, said first frame portion including a well having a peripheral side wall defining a cavity other than circular in cross-section in which a first portion of said side wall is relatively closer to the central axis of said well, a second portion of said side wall which is relatively farther from the central axis of said well than said first portion, said well including a bottom floor thereof, an aperture through said floor centered on its said central axis, the upper end of said reciprocating rod member of said shock absorber extending through said aperture into said well, said retaining nut being threaded on said upper end of said rod member, said tool comprising an elongated tubular member, a first opening to one end of a through-passageway through said tubular member, a second opening to the opposite end of said through-passageway, said second opening being annular and including engagement means to receive and engage said retaining nut of said shock absorber to hold against rotation relative to said tubular member, and projecting means projecting outwardly from said elongated tubular member, said projection means having an outermost edge, the distance between the outermost edge of said projection means and said central axis when said tubular member is seated on said retaining nut being greater than the distance of said first portion of said side wall to said central axis and less than the distance of said second portion thereof to said central axis.

2. A combination vehicle, shock absorber and tool to remove a shock absorber from a vehicle as set forth in claim 1, wherein said upper end of said reciprocating rod member includes a pair of opposed flat faces to receive a socket tool having a cavity of corresponding cross-section thereon for rotation of said rod member, a socket tool having said corresponding cross-section received through said through-passageway of said tubular member to seat on said upper end of said rod member, an extension shaft extending from said socket tool having a length sufficient to extend outwardly from beyond said first opening of said through-passageway of said tubular member when said socket tool is seated on said upper end of said rod member of said shock absorber, and means to rotate said extension shaft and said socket tool and said rod member in a direction to remove said rod member from said retaining nut held by said tubular member in seated engagement on said retaining nut with its said projecting means in abutting relationship against said first portion of said side wall of said well of said first frame member of said vehicle.

3. A combination vehicle, shock absorber and tool to remove a shock absorber from a vehicle as set forth in claim 1, wherein said first frame portion of said vehicle has an A-shaped exterior configuration and an opening at the top thereof opening to said well thereof.

4. A combination vehicle, shock absorber and tool to remove a shock absorber from a vehicle as set forth in claim 2, wherein said means to rotate said extension shaft includes a handle extending from the upper end thereof.

5. A combination vehicle, shock absorber and tool to remove said shock absorber from said vehicle as set forth in claim 1, wherein said engagement means of said second opening of said tubular member includes a plurality of spaced apart vertically extending ribs to grip and bear against said retaining nut when said engagement means is seated thereon.

6. A combination vehicle, shock absorber and tool to remove said shock absorber from said vehicle as set forth in claim 1, wherein said engagement means of said second opening of said tubular member comprises a nut engaging socket.

7. A combination vehicle, shock absorber and tool to remove said shock absorber from said vehicle as set forth in claim 1, wherein said projection means projecting outwardly from said elongated tubular member includes an elongated flange extending along the outer wall of said tubular member in a direction substantially parallel with the central axis of said through-passageway extending through said tubular member.

8. A combination vehicle, shock absorber and tool to remove said shock absorber from said vehicle as set forth in claim 7, wherein said elongated flange is integrally formed with said outer wall of said tubular member.

* * * * *